US007410377B2

(12) United States Patent
Wharton

(10) Patent No.: US 7,410,377 B2
(45) Date of Patent: Aug. 12, 2008

(54) ELECTRICAL MAINS PLUG AND SOCKETS SYSTEM

(76) Inventor: Geoffrey Wharton, c/o Chareah Lough, 11 Fox Lair La., Thornton, PA (US) 19373

( * ) Notice: Subject to any disclaimer, the term of this patent is extended or adjusted under 35 U.S.C. 154(b) by 696 days.

(21) Appl. No.: 10/793,730

(22) Filed: Mar. 8, 2004

(65) Prior Publication Data

US 2005/0014412 A1 Jan. 20, 2005

(51) Int. Cl.
*H01R 13/627* (2006.01)

(52) U.S. Cl. ..... 439/172; 439/353; 439/483; 439/620.3

(58) Field of Classification Search ..... 439/353, 439/357, 358, 148, 483, 693, 170, 172, 484, 439/620.3

See application file for complete search history.

(56) References Cited

U.S. PATENT DOCUMENTS 1,498,196 A * 6/1924 Pacent ..... 439/483
2,895,119 A * 7/1959 Montgomery, Jr. ..... 439/354
3,430,187 A * 2/1969 Man et al. ..... 439/462
5,024,603 A * 6/1991 Hsieh ..... 439/148
5,145,393 A * 9/1992 Schoon ..... 439/269.2
5,641,311 A * 6/1997 Chuang ..... 439/693
5,993,240 A * 11/1999 Schaefer ..... 439/359
6,051,788 A * 4/2000 Nichols ..... 174/67

* cited by examiner

*Primary Examiner*—Neil Abrams

(57) ABSTRACT

A plug and socket system for electrical coupling of mains power, and safety socket cap devices are disclosed. The devices are an in line plug device FIG. 2 with a removable Semi hollow plug spigot 6 that houses removable electrical pin means 9/10. A wire clamping means FIG. 12/5; is attached to the Semi hollow plug spigot in one embodiment to retain wires to the pin terminals. A locking latch means FIG. 2/7, locks both the socket and the plug together FIG. 1 by a cantilevered latch FIG. 8, which is pushed into the socket and then is held in position by an internal slot inside the socket FIG. 10/9. The latch is released by using leverage with one or more fingers inside a finger hold FIG. 1/4, while depressing a button FIG. 1/3 or series of buttons FIG. 9/2 and the two devices can be separated. A water-resistant seal is created by the inclusion of an 'O' ring FIG. 4/11. The Semi hollow plug spigot depth FIG. 3/14 into the socket device and the locking of the two devices creates a tamper proof chamber. A fault isolation means FIG. 12/3 is designed to prevent circuit components overheating.

19 Claims, 6 Drawing Sheets

L
E 11
12
13

1
2
3
4
5
6
7
N
L
E 1
2
6
7
8
9
10
N
L
E

13 AMPS
L
E
N

ELECTRICAL MAINS PLUG AND SOCKETS SYSTEM

TECHNICAL FIELD

This invention relates to improvements in devices for electrical plugs, sockets and many accessories that use Mains power electrical connections and equipment in the domestic, business, military and trades environments.

BASIC BACKGROUND OF THE INVENTION

This invention solves many of the safety problems that exist in the currently used Australian designed plugs and sockets. The existing system is used around Australia as well as China, New Zealand, Argentina, Fiji, Solomon Islands, Tonga—countries that have adopted the Australian plug and socket system or similar style in their domestic/business markets, hospitals and Trade Sectors.

This invention recognises the existing Australian Standards set out for Australian Plug and sockets Australian Standard 3112. The invention's initial electrical pin configuration is identical to the existing Australian Standard. This enables this invention to be backward compatible with existing Australian sockets.

This invention can be manufactured to conform to other countries pin configurations, countries such, as Japan, the United States of America and Canada as they rely upon variants of small two or three pin plug and socket systems.

The existing Australian Plug and socket system is designed as an 'in-line' configuration that uses a round casing shape for the plug. The electrical wiring comes directly into the rear of the plug, which in turn then fits directly into the socket. This existing Australian design is best illustrated by the existing extension cord system as an 'in-line system'

The problem with the existing system is that it is far too easy to simply pull out the plug from the sockets by excessive pulling on the electrical wire cord. Or, say when a person is using an electrical Garden appliance in conjunction with the electrical extension cord. The existing system makes it extremely easy to pull out the plug from the socket, either completely of partially. It does not matter if it is partially exposed or completely, either way there is the immediate danger that there is live electricity exposed to anyone close to the compromised connection.

The Voltage of the Australian electricity system is 240 Volts. This is potentially lethal for adults, and deadly for young children who could become exposed to the Voltage. This is unlike other countries systems such as the USA where they operate on a much lower Voltage of 110V which can be tolerated better by a human. Even so, 110 Volts is still unpleasant to get a jolt from at any age.

This scenario can be potentially lethal where the live pins or contacts are partially or fully exposed. If this happens on damp grass and a blade of grass touches the exposed live pin, or socket hole then a whole area of ground can become electrified and the unwitting operator coming close to the area can be electrocuted. Other scenarios that exist is when a small child could be playing and the live pins have become exposed due to the plug becoming slightly disengaged from the socket. A child could explore by inserting his/her very small fingers or a small metal object into the live terminals with again potentially lethal consequences.

The typical Australian plug is normally round in shape and has little grip for any finger. The Australian plug is difficult to handle making it very awkward for many people to insert or pull out the plug from sockets. In some cases, operators resort to pulling a plug out by the cord. This can eventually pull the wires out of the plug creating hazards such as wires crossing inside the plug and causing an internal electrical shorting, when damage can occur.

In some cases an operator will loop-tie the extension cords together to stop the plug and socket from separating.

The existing plug size creates a small footprint, onto which someone's fingers could accidentally slip off and touch the live pins. Children's fingers who have much smaller fingers and hands can accidentally slip their grip and touch the live pins when they attempt to pull the plug from the socket on the wall. It does not matter whether the hand is young or old—this is a potential problem for anyone, more so for those with dexterity difficulties.

This lack of a footprint has an inherent problem in that the plug has a tendency to wobble when it is located in the existing Australian designed socket. This can be seen when a vacuum cleaner is in use around the home and the plug is semi pulled from the socket. At times this has the potential of moving to one side and the exposed pins can be seen. Sometimes this results in an electrical flash taking place as the pins fail to connect correctly. This has the added potential problem that fluid could travel into that exposed crack and create an electrical leak. An example of that hazard is when water is around the operating zone, say in a kitchen. A combination of a loss of concentration, cleaning surfaces with water and a plug that becomes moist can become a potential lethal problem for the user.

This potential scenario could have lethal consequences in around any area, more so in the work zones of homes, offices, hospitals, military operations and light or heavy industry.

To add to this potential lethal problem—Australian Standards has now introduced an outer cup device, on the extension cord socket. Its purpose is to create a physical barrier to protect fingers from accidentally coming into contact with the live pins. Unfortunately this 'cup' can act as a superb device to hold water. Fluid build up can be as simple as moisture from damp grass. If a plug should come partially come out of the socket, while the pins are still live, an operator can be accidentally electrocuted from electrical leakage in contact with any fluid that may have built up inside this 'cup like device'

In addition to the electrical leakage scenarios is the problem of an electrical appliance that become faulty, there is no independent cut-out system inside the standard Australian electric plug. There is no independent cut-out, that isolates the appliance from other items in circuit, should one appliance becomes faulty, The problem is compounded by the traditional use of only one fuse box inside the house or business operation. The theory is that if an appliance is faulty and it 'blows', it will trip the mains fuse in the fuse box. This has a serious flaw in the thinking, as many mains circuits will have a fuse rated at 15 AMPS. If an appliance is on that same circuit and it is rated at say only 8 AMPS and it becomes faulty, as that is a lower rating than the 15 AMP fuse, it will not blow the mains fuse. The current will still flow even though it has a fault on that circuit.

As a direct result, the wires on the faulty appliance can overheat and a fire can result. Many house fires in Australia are a result of electrical fires. The existing Australian electrical system has no prevention to stop electrical wiring from overheating.

Another cause for concern is that even if the mains fuse does blow, isolating that circuit, then the next problem is how to identify the offending appliance. If someone was to simply replace the blown fuse at the mains board, when power is switched back on the fuse will blow once again as the offending appliance is still in circuit.

The present Australian system fails to allow any user/operator to quickly identify which appliance is at fault. With the present Australian system to find the offending appliance can be a very long process. A process where it may mean a great deal of time trying to find which appliance is at fault by trial and error.

Additionally, the existing Australian plug and socket system offers limited safety for the trades person who is working on industrial sites where the location of work is at times less than perfect for the operator. Electrical cords can find themselves in adverse conditions in areas where there is moisture, rain or liquids; all potentially lethal for the operator and any unsuspecting worker in the locality.

The present plug and socket system fails to isolate the electricity in case of appliance failure or short circuit caused by moisture contact. Another scenario is that if an appliance does fail it will trip the mains fuse and other equipment that may be in use for giving another operator a 'life support system'. If an appliance fails on a major worksite the mains fuse may blow but then there is in the major task of identifying the offending appliance would become a time consuming element again for the workers. If the current is put back on and the offending appliance becomes live again when someone is close by inspecting the appliances for faults, the operator could become an unwitting potential victim of the electricity coming back on circuit.

These problems have been compounded by successive changes with the Australian plug and sockets. Many households and businesses own older style plugs and sockets. Many do not comply with modern thinking about safety concerns. There is no system of 'policing' homes or businesses for old designs that do not comply with the latest in design thinking—there are always left over designs that then compromise the system as a whole.

SUMMARY OF THE INVENTION

These problems are overcome by the present invention, which provides a plug and socket system for electrical coupling of mains power of domestic and industrial plugs, sockets and safety socket cap accessory devices. These work by pushing the plug device into the socket device which mate tightly, automatically snap locking by way of an internal latch or latches. The Semi hollow plug spigot (the plugs inner body) engages inside of the socket internal chamber which houses an 'O' ring to make a water resistant seal. The combination of the latch and the Semi hollow plug spigot insertion creates a tamper-proof chamber.

To release the plug from the socket the operator puts two fingers into a finger grip, which provides a secure grip onto the plug device, then presses down a button or plurality of buttons in other embodiments, which pushes down the internal latch which releases the plug from the socket. For additional safety, the release safety button slides axially along the plug body to be able to be parked in a non-operating mode and then slid along to become operational. This feature resists smaller children from trying to explore or trying to disengage the plug from the socket.

The principles of the invention mechanism of the button release device are not limited to one method of manufacture.

This invention creates a whole new system of plugs and sockets, adapters, converters and safety socket cap adapters. This Invention considers professional Trades that use electricity to power their appliances and the home handy person.

This invention's Semi hollow plug spigot device is located within the plug device. The Semi hollow plug spigot creates many advantages for manufacturing as well as wiring up by the home handyman or Trade person. The Semi hollow plug spigot device is removable from the plug device body. This means that in manufacture the same or similar plug body can be used while the Semi hollow plug spigots can be altered to meet new pin configurations for other countries such as two pin or three pin variants, round or flat shapes. The Semi hollow plug spigot device can be manufactured with or without a fuse component to suit country laws or their needs for a fuse in line.

The Semi hollow plug spigot device has been invented in a longitudinal cylindrical manner.

The Semi hollow plug spigot device removal allows the pins to be wired up in embodiments of the invention where the plug device is sold as an after/market appliance product, so it can be wired up to any appliance. Each electrical pin post device is slotted into position into carefully positioned holes that align the pins to the normal terminal positions as determined by the countries standard pin configuration. Conversely, these are removed by pulling upwards out of the hole in the male mould, and can be removed individually and independently to allow the operator to wire up the plug. They can be individually inserted and pulled out of the Semi hollow plug spigot. This system also allows each pin to be replaced should one become bent or damaged, making the plug serviceable. The wires are inserted into each pin head through a hole and the wire is then clamped into place by way of a screw. Each pin is coated to comply with new Australian Standards. Although, each pin is colour coated to a new invented length to stop any live metal from being exposed to the operator and to allow for identification of each pin.

Each pin will make contact with internal pin receptors that are placed inside the inventions socket device. These shaped pin receptors push the pins away, stopping secure contact from being made, until the operator firmly pushes the plug into engagement when the plug snap locks fully into place. The electrical pin connections are invented to a length where they only become live when the two devices are located. This invention stops the operator getting power unless the plug and socket are locked together.

In a heat sealed plug embodiment, one that is sold with an appliance, the fuse may be replaced by way of a latched cap on the side of the plug housing.

This invention has an internal clamp device, on which embodiments can be manufactured onto the Semi hollow plug spigot or onto the female cowling. This stops wires from being pulled out of the plug and accidentally compromising the connections. Any wire pulled out inside a plug can short the circuit accidentally. If the Cord needs to be adjusted during the initial wiring up phase, the operator simply adjusts the downward pressure on the Clamp device.

In various embodiments of the plug device and socket device, the 'O' Ring can be manufactured inside the socket wall, or on the mating face of the plug or socket or along the shaft of the Semi hollow plug spigot. The principles of the invention are not restricted to manufacturing choice.

The inventions system is backward compatible, in so much that the plug is able to connect with existing sockets as the pins configuration is consistent with the AS 3112 or any other countries standard pin configuration where it may be in use to conform with that countries pin layouts. Although not all the benefits will be available if not all of the inventions devices are used in conjunction with each other.

This invention is an improvement over existing art where other art forms used to overcome accidental plug removal use rotating collar/s devices, moving parts or screws to hold devices together and or; where their emphasis for invention consideration is primary to overcome the irritation of connection loss. Those inventions rely upon the operator to lock the two devices together by rotating the collars to lock the two devices together while electricity can still flow between the two devices even though unlocked. That approach relies upon human participation which may introduce error for those people who tend to overlook the need to lock the devices together.

This invention introduces as its main priority a high level set of safety considerations in the invention and all of its devices.

This invention uses "O" ring seals to create a water resistant seal. A tamperproof chamber is created around the electrical connections by way of this inventive step of the snap locking system. The pin socket holes are well recessed compared to standard sockets that are currently in use where the socket holes are flush with the outer casing and easier to probe into by metal objects by children. This chamber will inhibit water ingress and help reduce accidents that occur when water is in use say a kitchen, bathroom or in the garden when extension cords are in use. This inventive step overcomes the problem when plugs are accidentally pulled out of the extension socket creating the possibility of a blade of grass or other conducting medium touching any live pins. This invention makes a clear distinction that is does not claim to be a water proof connection, in other words one that allows the operator to submerge the plug and socket under water.

This inventive step prevents the plug device from wobbling around on the socket, by making it secure in the socket device.

This invention overcomes any accidental exposure to the live pins on an existing plug such as when a child can become inquisitive with small paperclips, therefore reducing accidental electrocution from compromised connections on the extension cord, by its nature of being secured in the socket device. The invention Semi hollow plug spigot device alignment makes it near impossible to get any foreign object close to any live pin while a plug device is located.

This inventions socket device makes each connection secure and safer as it reduces accidental removal of the plug out of the socket.

The invention of the wall socket device can replace wall sockets in the home, business, hospitals and military applications where a secure, safe connection is required.

Existing plugs can use the inventive socket device, by using the invention's adapter device although none of the benefits will flow on, it just allows older plugs on appliances to still work if required.

The invention also overcomes the existing problem of isolating an appliance that becomes faulty in circuit. A fuse device introduced into each Plug will be expected to blow if wires start to overheat. This will then isolate the offending appliance and reduce the risk of electrical fires. This will make it easier to identify which is the offending appliance and help prevent any accidents when current is placed back on whether it is in the workplace or in the domestic environment.

This step is created by way of placing a fuse into the Live terminal side of the Plug. This is designed to relate to the amperage of the appliance that is in use. Should an appliance become faulty then the fuse will blow, leaving the appliance isolated from the current. This has an enormous benefit when many appliances are in use on the same circuit and one fails.

This step allows for an offending appliance to be identified and the user to get it repaired by an Electrician.

A flexible type sealing gland device creates a longer and firmer grip on the wires that go into the Plug. This in turn reduces strain that is placed upon the wires inside the cabling and helps to prevent the internal wires from fracturing which in turn will create an appliance to fail. This step addresses and overcomes the potential damaging of electrical wiring inside the cable prematurely by normal or by heavier usage of the pulling and winding of the cord around the plug itself when appliances are being used such as vacuum cleaners in the domestic environment.

The Extension/expansion Board device uses the inventive socket device, over multiples. It utilises the same components as the inventions Socket device, but allows multiple appliances to be inserted into the unit. This can be manufactured in units of two, four six and eight Sockets. Australian Standards 3112 does not permit an inbuilt fuse inside sockets and therefore this Invention complies with that Standard. In other countries an additional fuse can be introduced into the Extension board socket device for added safety.

The invention has embodiments that include adapters. One is a four-way adapter that incorporates the invention features of the socket device and locates firmly into a two-plug wall socket. A further embodiment of this is a two-way adapter that fits into a single invention socket device. A third embodiment is a vertical two-way adapter that fits into a WallSocket.

The invention includes a Converter embodiment that allows for plugs from other countries to be able to use the Australian system and conversely or voltage converters and adapters. Or for any other country pin configuration that utilises this invention. The principles of this invention can be used in any other electrical pin configuration.

For children's added safety, a Cap device has been invented. This cap device operates with the snap locking device system, fitting over the Socket device, locking down with the same principles as the plug device into the socket. This Cap device requires two fingers to release two buttons simultaneously, which many younger children will not be able to accomplish due to the strength required in performing that task. This invention prevents foreign objects entering the exposed apertures of the Socket device when they are not in use, or while plug devices are not in position.

The Invention considers the hard environment that the Industrial versions will find themselves in. On the Industrial extension Board device, the moulding has a bubble formation. This allows the unit to fall and bounce if accidentally allowed to fall. Giving the unit far better protection in the punishing work environment. The industrial embodiments of this invention are assisted with this choice of material, as the material will be more resistant to harder wear and tear and hard knocks. It will be petrol and oil resistant by using Nitrile Rubber, or similar compounds. The industrial plug and socket will benefit from the rubber in its manufacture as when the two components mate, they will have a firmer and more snug fit, making fluid far more difficult to enter the electrical components.

The Industrial System devices will be manufactured in a high visibility colour and durability, as these will be manufactured in Fluorescent Nitrile Rubber or of materials with similar qualities. This material has the added advantage that it will not crack in hard working conditions—unlike the normal UPVC models that are currently in use. This has the distinct advantage of being more visible to make it easier to see in darker and hard working conditions.

The Domestic versions of these units will be manufactured in UPVC or similar manufacturing materials.

Embodiments of this invention are appropriate for the USA, Canadian, Japanese and other countries that rely upon a two or three pin or other electrical connector devices to connect to the electrical power supplies.

Other embodiments of the invention embodying the same or equivalent principles may be used and structural changes may be made as desired by those skilled in the art without departing from the present invention and the purview of the appended claims.

To assist with understanding the Invention reference to the accompanying drawings that shows examples of the inventions as a whole.

In the drawings:

FIG. 1

Shows the Plug and socket devices connected, the flexible type sealing gland device, the Handle device according to this invention and the application;

FIG. 2

Shows one plug device embodiment with an "O" ring around the parameter of the plug device according to this invention and the application;

FIG. 3

Shows the Extension Socket device internal pin connectors according to the invention and the application of the Plug device;

FIG. 4

Shows the plug device embodiment with 'O' Ring around the Semi hollow plug spigot device according to this invention and the application;

FIG. 5

Shows the socket device with an internal 'O' ring inside the socket wall embodiment according to the invention;

FIG. 6

Shows the plug and socket devices locked together in a typical extension cord situation, with a dual release button embodiment according to this invention;

FIG. 7

Shows a top view of the Plug device with latch and release button according to this invention;

FIG. 8

Shows release button in one embodiment with a spring in accordance to this invention;

FIG. 9

Shows the plug device in a dual release button embodiment in accordance to this invention;

FIG. 10

Shows the plug and socket devices internal connection in accordance to this invention;

FIG. 11

Shows a ¾ view of the Semi hollow plug spigot with a pin-retaining clip in accordance to this invention;

FIG. 12

Shows the Semi hollow plug spigot with the in-line fuse holder in position and the wire clamp in accordance to this invention;

FIG. 13

Shows a ¾ view of the plug and socket devices in an extension cord embodiment in accordance to this invention;

FIG. 14

Shows an Adapter to allow an existing Australian plug to be used with the new socket device in accordance to this invention;

FIG. 15

Shows a side plane of a plug device connected into a socket device in accordance to this invention;

FIG. 16

Shows a two-socket wall socket device in accordance to this invention;

FIG. 17

Shows the plug devices cowling; the Semi hollow plug spigot removed, the screw to hold the Semi hollow plug spigot to the cowling in accordance to this invention;

FIG. 18

Shows a rear view and front view of the Semi hollow plug spigot in accordance to this invention;

FIG. 19

Shows a two-way adapter in accordance to this invention;

FIG. 20

Shows the Safety Socket Cap device in location in the socket device in accordance to this invention;

FIG. 21

Show the Safety Socket cap device in one embodiment with internal leverage tensions bars to release the Latches in accordance to this invention;

FIG. 22

Shows the Safety Socket Cap in accordance to this invention;

FIG. 23

Shows a converter device that allows any plug from another country to use the socket device In accordance to this invention;

FIG. 24

Shows the Expansion board in a side view in accordance to this invention;

FIG. 25

Shows the Expansion board from a top view in accordance to this invention;

Referring to FIG. 1; it can be seen that the plug and socket system for electrical coupling of mains power one embodiment of a set of devices according to this invention comprises of a plug device 1 a socket device in the extension plug embodiment 2 with the release safety button 3 located on the plug device in an in-line configuration. The finger holds 4 are moulded into the plug and socket devices. The wire grips 5 are the end of each thereof. The plug device is seen in location and operation with the socket device. The locking of the two devices creates a tamperproof and water-resistant chamber by this action.

FIG. 2 shows the plug device in one embodiment. This embodiment is where the "O" ring 8 is manufactured onto the ends of the plug device. When the plug device is pushed onto the socket device it will squeeze the 'O' Ring creating a seal. Seen is the locking latch 7 which is operated by the release safety button 3 which is a cantilevered means action so as when it is pressed in a downward manner the resistance will force it back up into position, thus locking the latch firmly into place inside the socket device's internal recess. The Semi hollow plug spigot is seen in location 6 housing an Earth, Neutral and Live pin 9,10. The pins are coated to a length so that it creates contact when it is in location well inside the socket.

FIG. 3 shows one embodiment of the socket device 13. This chamber 14 is defined by circumferential wall 18 and axial wall 19 which abuts in close proximity to face 11 of plug spigot 6 shown in FIG. 2 when coupled, is invented to firmly accommodate the Semi hollow plug spigot from the plug device for FIG. 2. The Latch recess is seen 15 in FIG. 3 and shaped electrical contacts 17 and 20 are not in electrical connection until face 11 of plug spigot of FIG. 2 has entered chamber 14 of FIG. 3 beyond socket face 21 thereby ensuring electrical safety shrouding. Some minor pressure is required to push the pins into location while at the same time when they are located the Latch becomes located simultaneously to create a firm lock and sealed tamperproof and water resistant chamber.

FIG. 4 shows another embodiment of the plug device. The 'O' ring is located on the Semi hollow plug spigot providing an alternative for manufacturing techniques. This embodiment operates with FIG. 3—socket device embodiment. This illustration shows that the latch is shortened and the Semi hollow plug spigot lengthened in comparison to the other embodiment of FIG. 2.

FIG. 5 shows the socket device in another embodiment where the 'O' ring is seated 18 within the chamber of the socket device. This alternative will match with FIG. 2 of the Plug, device. This illustrates that the invention is not limited to one embodiment in manufacturing.

FIG. 6 shows the plug device and socket device in another embodiment where the plug device 1 has a multiple number of release buttons for added security when it is locked in position into the socket device. This embodiment will have added features for a family home where added security is required on all electrical fittings.

FIG. 7 shows a top projection of the plug device in one embodiment 6. It is shown the latch device 7 sitting in the Semi hollow plug spigot's flat top. The finger holds are seen with apertures that allow the fingers to go through or nearly so, and hold the outer moulding.

FIG. 8 shows the release button 4 in one embodiment. The button is held up in position by a cantilevered means 5. This mechanism sits inside of the plug devices cowling.

FIG. 9 shows the plug device in another embodiment where two release buttons 2 are in operation. The latch 3 device is shown as a multitude of latches in the flat spot on the Semi hollow plug spigot.

FIG. 10 shows the plug device and the socket device in one embodiment engaged. It shows the pins in location within the electrical receptors, the latch located in the socket devices internal retaining recess. The 'O' ring is shown in position creating a water resistant seal.

FIG. 11 shows the Semi hollow plug spigot 1 in a ¾ view. This illustration shows the way the electrical pins 9 are located by way of a clip device 8. The illustration does not include other devices to keep the illustration workable. This shows the shape of the Semi hollow plug spigot with the flat top 2 and in one embodiment where the 'O' ring 6 is located onto the Semi hollow plug spigot housing. Holes 10 in the moulding allow for electrical wires to be fed down into the bottom portion of the Semi hollow plug spigot to create anti-tracking barriers.

FIG. 12 shows the Semi hollow plug spigot 1 with the Live pin 3 and the in-line Fuse 4 in location in this embodiment. In other embodiments, the fuse may not be required to meet certain countries Standards. This illustration shows the clamp means 5, which holds the wire cable in place to stop wires from being pulled out of the Pins 7.

Figures 1, 2, 3, 4, 5:
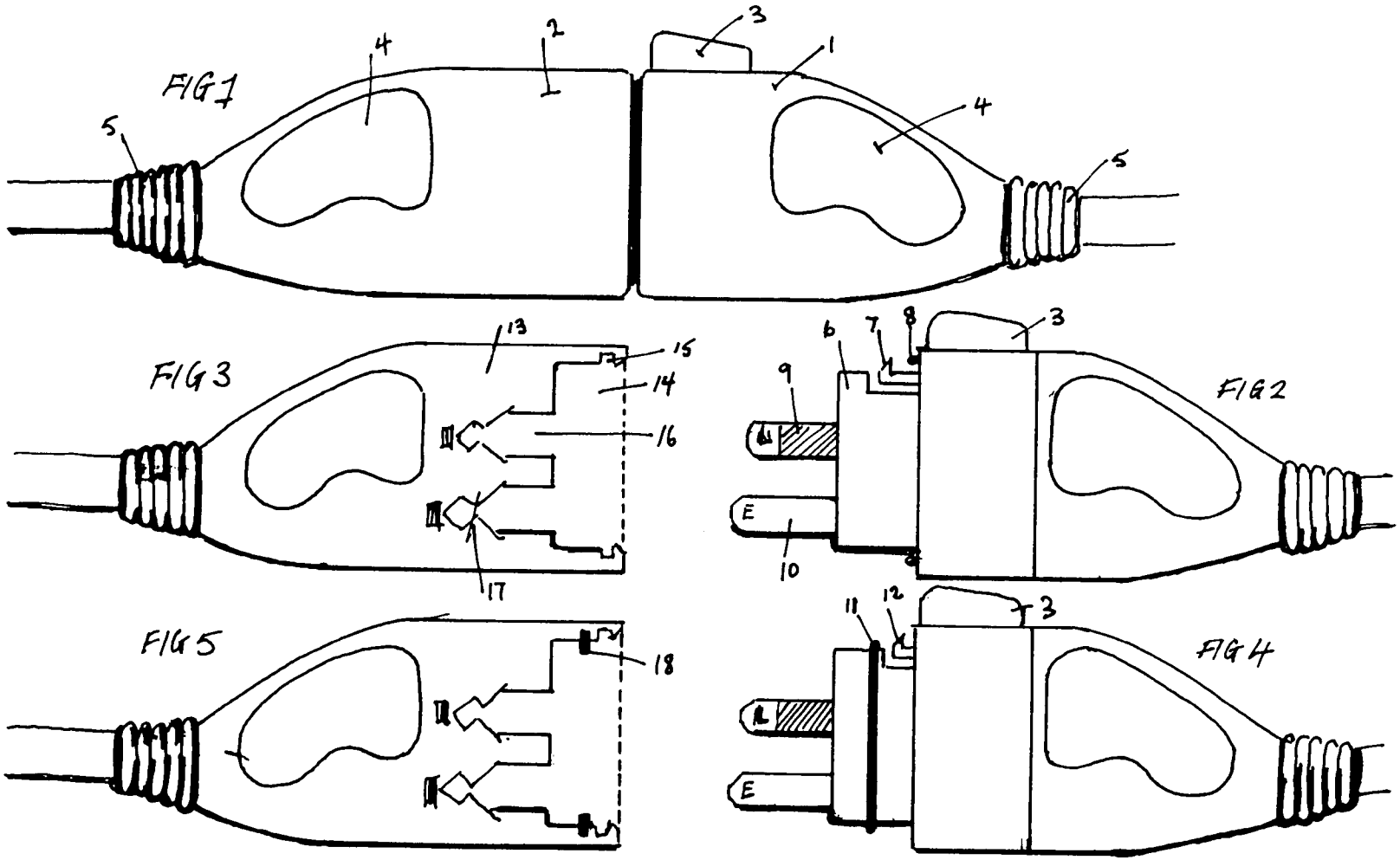
Figures 6, 7, 8, 9, 10:
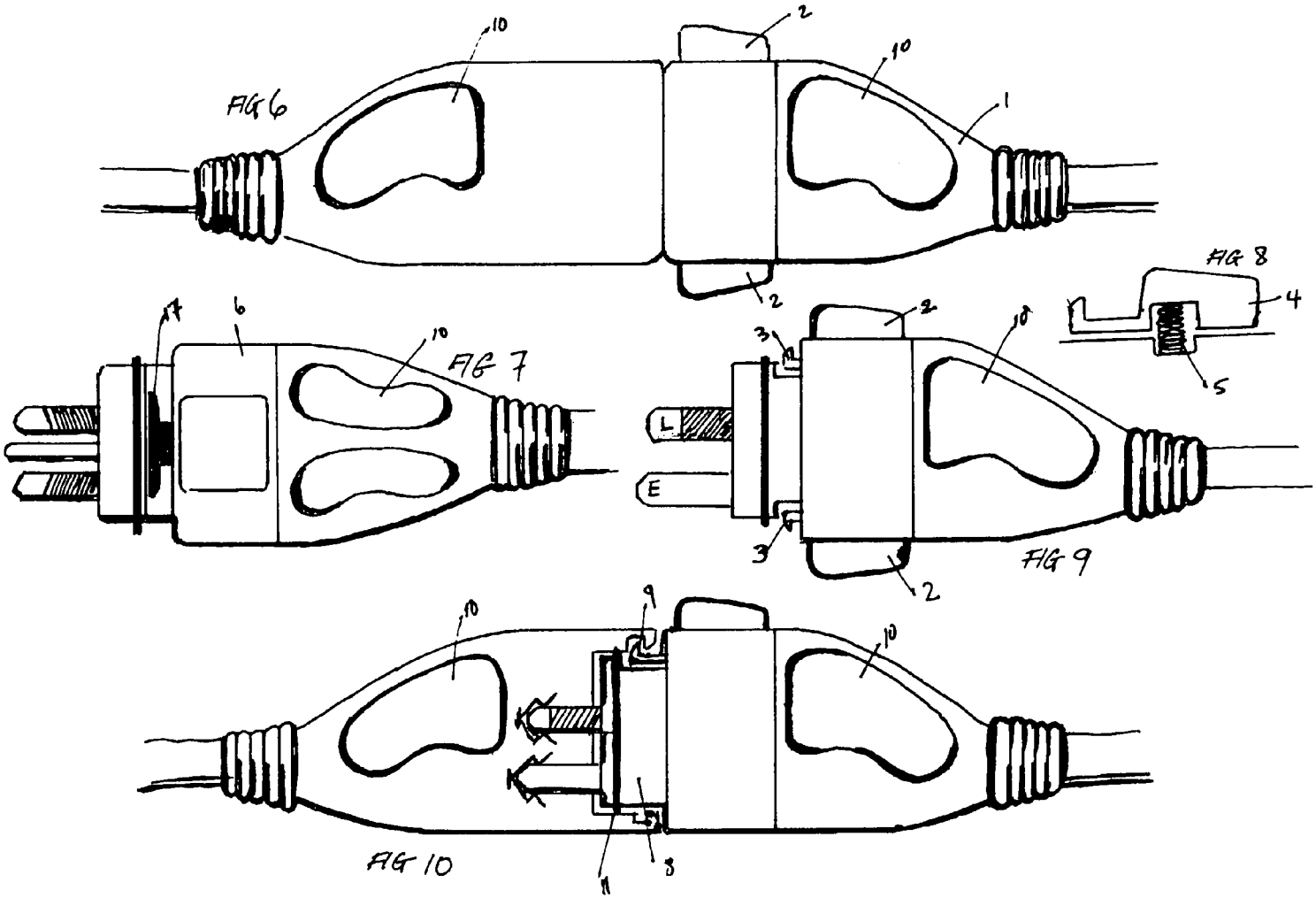
Figure 13:
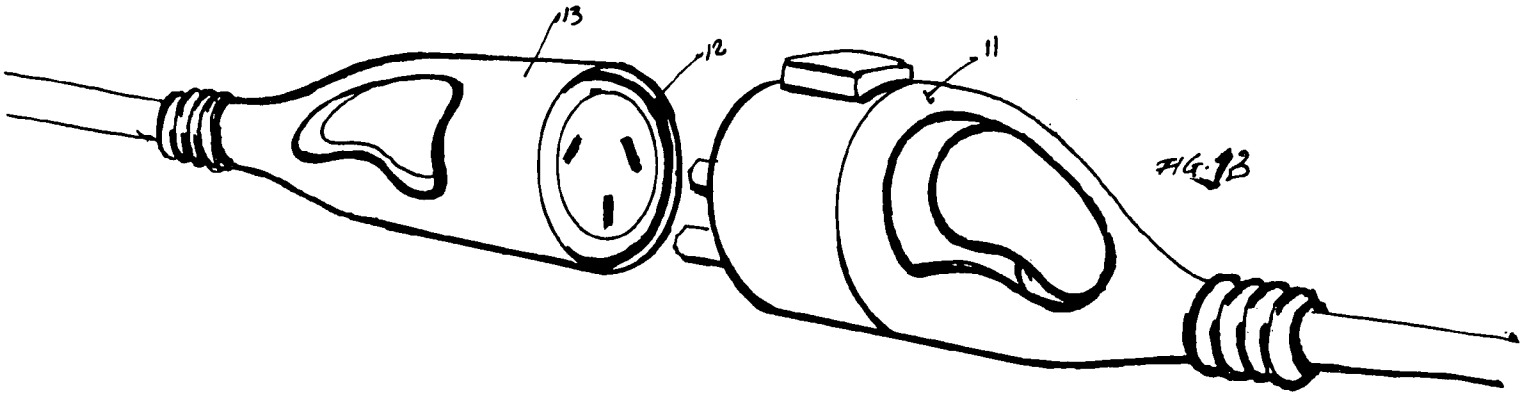
FIG. 13 Shows a ¾ view of the plug device about to enter the socket device.
Figure 12:
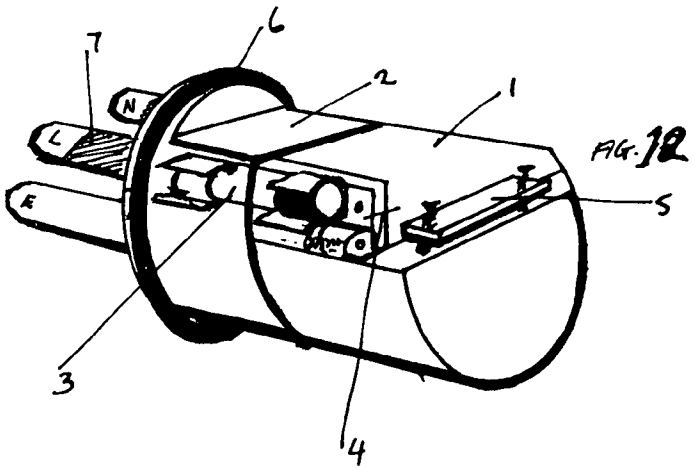
Figure 11:
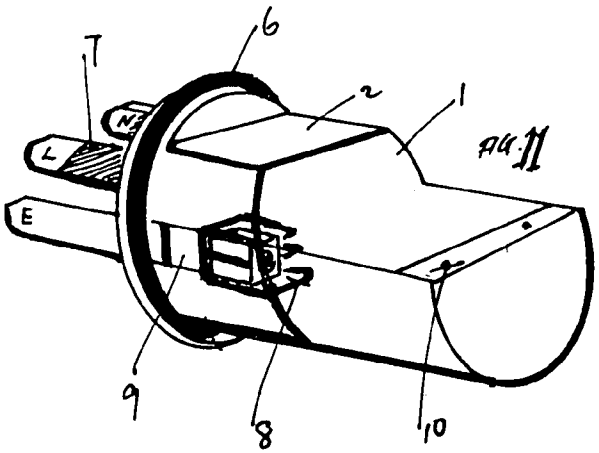
Figure 15:
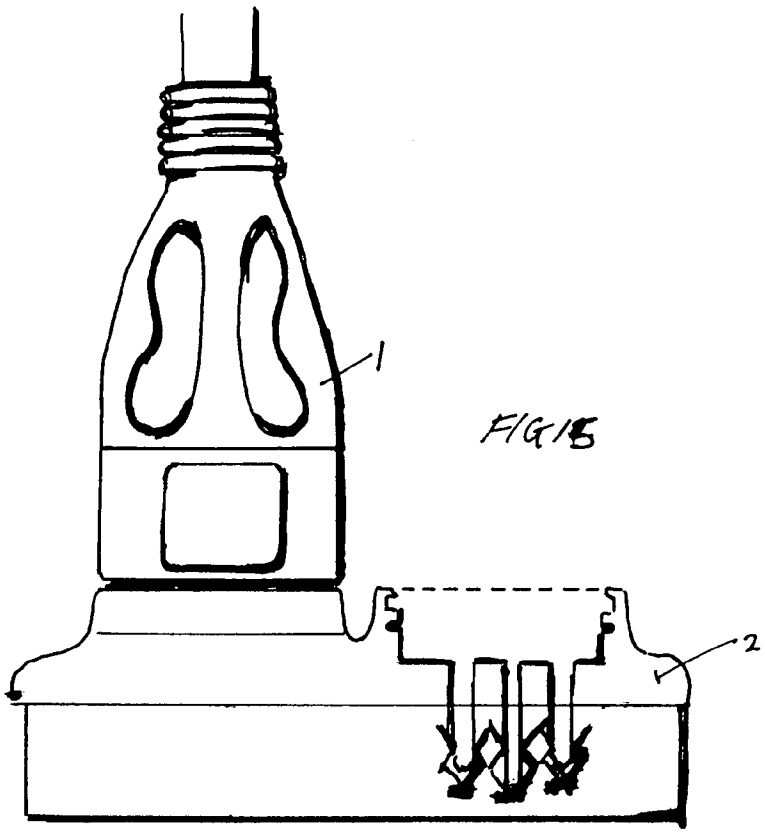
FIG. 15 shows the plug in location in the wall socket device embodiment of the invention.
Figure 14:
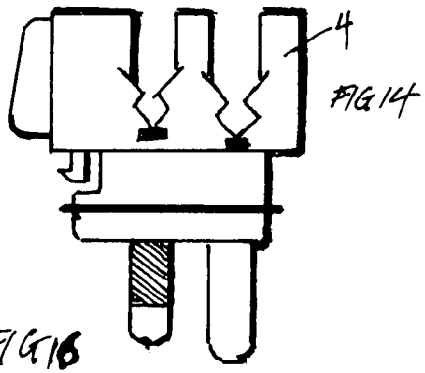
FIG. 14 Shows an Adapter device that existing plugs use to connect to the inventions socket devices. This allows for connection but does not provide the benefits of the water resistance or tamper proof qualities that this invention system provides when all its components are used in connection with the other.
Figure 16:
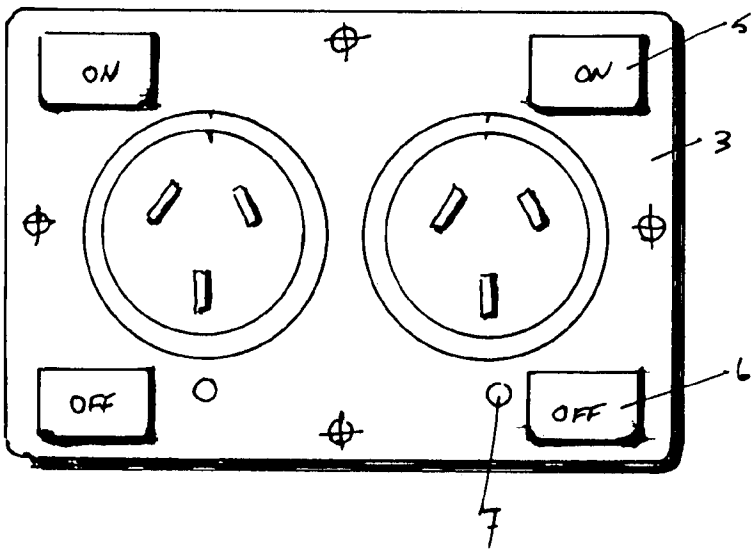
FIG. 16 Shows the wall socket devices embodiment with manufacturing options on operating switches.
Figures 17, 18, 19, 20, 21, 22, 23:
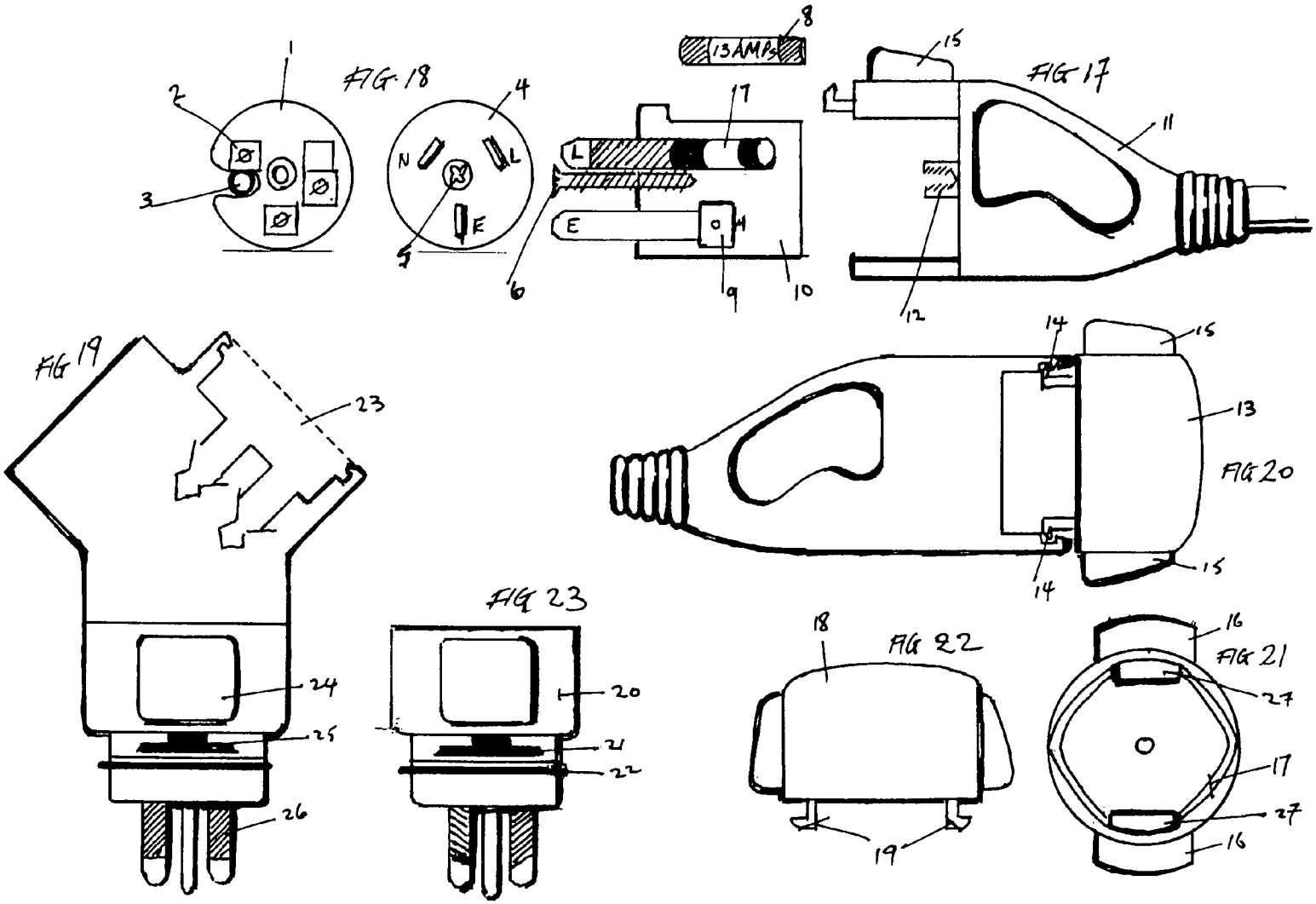

FIG. 17 shows the plug devices body. The body houses the release button device 15. The Semi hollow plug spigot is inserted into the body and locked into position 6 and the screws lock 12. The principles of the invention are not limited by the way the Semi hollow plug spigot 10 is manufactured to locate into the plug device body. The Semi hollow plug spigot 10 holds the Electrical Pins in any format, be it three flat pins, round pins, two pins or connectors. A fault isolation means 8 is inserted in the holder 17.

FIG. 18 shows end views of the Semi hollow plug spigot 1 and 4. The Pins are positioned in this embodiment to relate to Australian Standards 3112. The layout in the internal view 1 shows the pins in location and fault isolation means.

FIG. 19 shows an adapter embodiment with two plug devices are able to be inserted into the one adapter unit and which in turn then plugs into one socket device.

FIG. 20 shows the Safety Socket Cap 13 in location in the socket device embodiment. The release buttons 15 are in multiples to discourage the use of the device by children. The device also adds additional protection to the system when a plug device is not located into the socket devices.

FIG. 21 shows an embodiment of the Safety Socket Cap where two latches are in operation. This embodiment shows internal hinges 17, which create a spring tension against the latches 27, pushing them back into their original position.

FIG. 22 Shows the Safety Socket Cap in a side view. The latches are shown 19.

FIG. 23 shows one plug converter device set device end that allows for any configuration of other countries plug to be inserted in its end so that inter connections can be made. This embodiment does not limit the principles of the invention by which way the plug and sockets are used.

Figure 24:
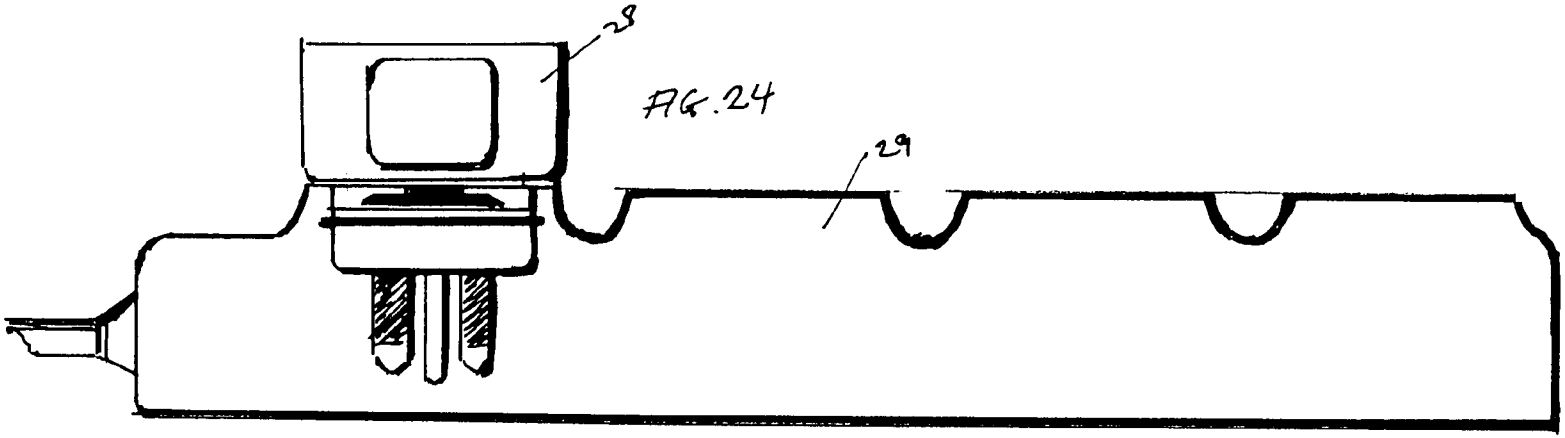

FIG. 24 shows the expansion/extension board with a plurality of socket devices in line. The illustration shows one embodiment of the plug device in location.

Figure 25:
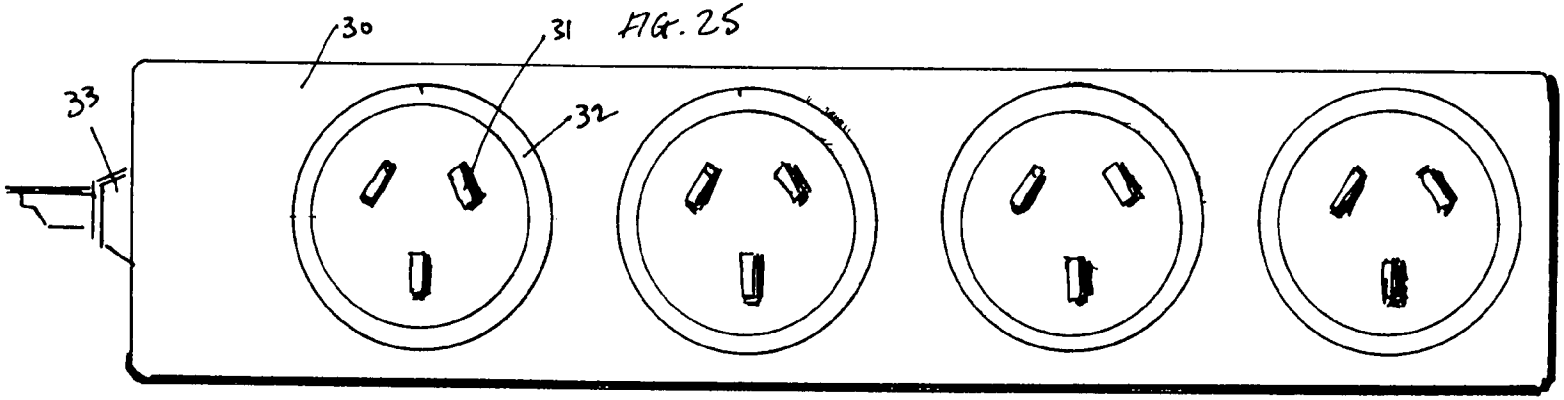

FIG. 25 shows the top view of the expansion/extension board device with a plurality of socket devices. The device is not limited to any number of socket devices that can be manufactured in one unit.

The snap locking electrical plug and socket system set of devices work by pushing the plug device into the socket device which mate tightly and in combination with an 'O' ring to make a water resistant seal locking by way of an internal latch or latches creating a tamper proof chamber will make using electrical plugs and sockets more reliable.

It will be realised that the snap locking electrical plug devices and socket devices according to this invention it is understood that these are capable of variation and modification and I therefore do not wish to be limited to the precise details set forth, but desire to avail ourselves of such changes and alterations as fall within the purview of the following claims.

I claim:

1. A plug and socket system for electrical coupling of mains power comprising:—

A moisture resistant appliance electrical plug and socket arrangement that comprises a plug device including a body having a semi hollow plug spigot with internal chambers which projects from the front face of the plug body being insertable into a corresponding chamber of the socket body with electrical contact plug pins that project from the front face of the semi hollow plug spigot to engage corresponding socket contacts in recesses at the bottom of the chamber of the socket body whereby the dimensions are such as to prevent the making of electrical contact until the shrouding has occurred, a) A plug device including a body having a removable and replaceable semi hollow plug spigot with internal chambers which project from the front face of the plug body being insertable into a corresponding chamber of the socket body having electrically conductive plug pins that project from the front face of the semi hollow plug spigot to engage corresponding socket contacts in recesses at the bottom of the chamber of the socket body, b) a socket device with a body having an internal chamber with an open face for receipt of the electrical semi hollow plug spigot, c) internal latching means provided between the plug body and the socket body which automatically engages into location to lock the plug to the socket when the semi hollow plug spigot is fully inserted and electrical connection is made, d) latch release means provided by a moveable release button projecting from the exterior of the plug body and being actuable to release the latch, permitting disengagement of the plug from the socket, whereby direct access is restricted from the exterior of the plug or socket bodies to the latch while the plug and socket bodies are engaged and interlocked, e) the plug contains an individual and optional axially aligned replaceable line current carrying fuse of chosen current rating better able to afford appliance protection and safety than reliance solely on the mains supply fuse, coupled and secured to a matching socket by a tamper resistant latch.

2. The plug and socket system for electrical coupling of mains power of claim 1 wherein, the semi hollow plug spigot includes an internal recess chamber for an electrical fault isolation means electrically connected between at least one of the plug pins and a corresponding conductor of the power input cable to isolate the power to the plug power output cable on the occurrence of a fault, a) wherein, the plug body has an inner chamber with an open face into which the semi hollow plug spigot inserts and is retained into position.

3. The plug and socket system for electrical coupling of mains power of claim 1 wherein the semi hollow plug spigot has a flattened surface along the top outer circumference to enable a unique angular position, to provide positive location within the plug chamber and to provide provision for the movement of the internal latch mechanism.

4. The plug and socket system for electrical coupling of mains power of claim 1 wherein, the means of the release button embodies a single release action or dual action whereby it actuates the release of the internal cantilevered latch and docks in a non operating position stopping actuation.

5. The plug and socket system for electrical coupling of mains power of claim 1 wherein, a sealing means provided on the socket body or the plug body or semi hollow plug spigot or both to cooperate with the other of the bodies thereby preventing the entry of fluids into the couple and sealing on cable entry ends.

6. The plug and socket system for electrical coupling of mains power of claim 1 wherein, socket contacts housed within the socket body at the bottom of the socket chamber away from the open face for the receipt of the plug contact pins, to engage the plug pins whereby the pins and socket contacts become electrically shrouded as the semi hollow plug spigot is inserted into the socket body chamber recess.

7. The plug and socket system for electrical coupling of mains power of claim 1 wherein, the electrical pins in the semi hollow plug spigot internal chamber are individually removable from their locations and relocatable into position by clip retention means.

8. The plug and socket system for electrical coupling of mains power of claim 1 wherein, the socket and plug form single integral body to form plug and socket adapters.

9. The plug and socket system for electrical coupling of mains power of claim 1 wherein, the plug or the socket are compatible for use with existing plugs or sockets whereby using adapters.

10. The plug and socket system for electrical coupling of mains power of claim 1 wherein, the plug or the socket body or both are sealable during manufacture with all electrical connections and cable sealing or with a dismantle means for after-sale wiring.

11. The plug and socket system for electrical coupling of mains power of claim 1 wherein the portion of electrical cable residing within the plug and the socket is retained against withdrawal from the plug or socket and against mechanical strain on the electrical connections by a clamp means.

12. The plug and socket system for electrical coupling of mains power of claim 1 or 6 wherein the semi hollow plug spigot chamber containing an electrical fault isolation means embodies a removable self contained line fault protection device that is selected from an appropriate rating range of current carrying capacities to enable fault protection at a lower circuit rating than afforded by the mains supply fuse without disrupting other circuit fed equipment.

13. The plug and socket system for electrical coupling of mains power of claim 1 or 8 wherein, the socket pin receptors are manufactured to meet country specific layout arrangements.

14. The plug and socket system for electrical coupling of mains power of claim 1, 2, 3 or 9 wherein, the semi hollow plug spigot is interchangeable or replaceable with country specific electrical pin layout arrangements.

15. The plug and socket system for electrical coupling of mains power of claim 1, 2, 3, 9, or 10 wherein, the electrical pins in the semi hollow plug spigot have wire receptor means for individual wiring to the electrical cables.

16. The plug and socket system for electrical coupling of mains power of claim 1 or 11 wherein, the socket body can be incorporated into a socket including an array of socket chambers to form multi-socket unit or units.

17. The plug and socket system for electrical coupling of mains power claim 1, or 11 wherein, the plug and socket maybe a single or multiple body plug or socket adapters or convertors from one electrical system to the other or international plug convertors or electrical voltage changing transformers with differing and varying input and output socket arrangements or with multiple plug and socket or socket outlets or with fault protection devices or with earth leakage protection whereby a tripping mechanism can be set and reset by actuation of a visible button or plurality of buttons.

18. The plug and socket system for electrical coupling of mains power of claim 1, 6, 13 or 7 wherein, the semi hollow plug spigot chamber containing an electrical fault isolation means where country specific Electrical Standard Authorities permit.

19. The plug and socket system for electrical coupling of mains power of claim 1, 4 or 18 wherein, the plug or external socket or both are provided with finger holds on the exterior body whereby to provide finger grip when releasing.

* * * * *